US006135660A

United States Patent [19]

Stevens et al.

[11] Patent Number: 6,135,660

[45] Date of Patent: Oct. 24, 2000

[54] MARKING INSTRUMENTS

[75] Inventors: Christopher John Stevens; Graham John Simms, both of Reading, United Kingdom

[73] Assignee: The Gillette Company, Boston, Mass.

[21] Appl. No.: 09/393,401

[22] Filed: Sep. 10, 1999

Related U.S. Application Data

[63] Continuation of application No. PCT/US98/05688, Mar. 24, 1998.

[30] Foreign Application Priority Data

Mar. 27, 1997 [GB] United Kingdom ..... 9706461

[51] Int. Cl.[7] ..... B43K 7/12

[52] U.S. Cl. ..... 401/107; 401/99; 401/103

[58] Field of Search ..... 401/99, 103, 107, 401/108; 600/562, 564, 565, 566, 567; 604/167, 202; 138/90, 112

[56] References Cited

U.S. PATENT DOCUMENTS 5,429,609 7/1995 Yoon ..... 604/167
5,823,697 10/1998 Talbot ..... 401/108

*Primary Examiner*—Steven O. Douglas
*Assistant Examiner*—Peter deVore
*Attorney, Agent, or Firm*—Chester Cekala

[57] ABSTRACT

A retractable marking instrument has a seal arrangement for sealing the marking tip (3) when it is retracted within the barrel. The seal arrangement comprises a sealing element (6) shaped as a torus which rolls between the barrel (1) of the instrument and a refill unit (2) carrying the marking tip (3).

12 Claims, 13 Drawing Sheets

MARKING INSTRUMENTS

This application is a continuation of PCT/US98/05688 filed Mar. 24, 1998.

This invention relates to marking instruments and in particular the invention is concerned with retractable marking instruments, that is marking instruments of the type comprising a barrel, and a member carrying a marking tip which is movable relative to the barrel, frequently by means of a retraction mechanism included within a rear end portion of the barrel, for displacement between an operative position in which the marking tip protrudes from the open forward end of the barrel, and an inoperative position in which the marking tip is retracted within the barrel. Retractable marking instruments are convenient when the marking tip is of a kind which will not dry out during periods of non-use, such as a ball point pen which use a viscous ink, since it is not then required to form an enclosure around the tip when it is retracted. For other kinds of marking instrument, such as pens with nibs or ball points which use liquid ink, fibre tip pens, felt tip markers, etc where there is a tendency for the marking fluid to dry out at the tip and cause problems when the instrument is to be next used again, it is most common for the barrel to be supplied with a removable cap for fitting to the barrel to enclose the tip during periods of non-use. Separate caps are effective in avoiding the dry out problem, but are not ideal in that they can become misplaced or lost. Various attempts have been made to include a sealing arrangement within the barrel of a retractable marking instrument, but none have proved both satisfactory and acceptable. Many of the prior art sealing arrangements demand the use of large barrel diameters, are expensive to manufacture, or can not ensure a satisfactory seal.

The present invention aims to provide a seal device in a marking instrument which overcomes the limitations of the prior art seal arrangements, and in accordance with the invention there is provided a marking instrument comprising a barrel having an opening at the forward end thereof, a member carrying a marking tip for movement through the opening between an operative position protruding from the barrel and an inoperative position retracted within the barrel, and an annular sealing element arranged within the barrel for frictional contact with an inner surface of the barrel and the member, whereby the sealing element rolls therebetween during movement of the marking tip between the operative and inoperative positions.

A sealing element as provided in a marking instrument according to the invention is economic to manufacture and assemble within the barrel and it can provide an effective sealing performance without demanding a barrel of large diameter. The sealing effect can be produced by the sealing element in different ways. The sealing element may close the barrel interior forwardly of the retracted tip to form an enclosed space around the tip. Alternatively the sealing element may contact or envelope the retracted marking tip to seal off the tip. The sealing element is conveniently formed substantially in the shape of a torus and it may have slits or slots around its periphery to reduce the stresses created in the material of the sealing element during its rolling motion. The sealing element may be made of a soft rubber or rubber-like material with a substantially circular initial cross-section which is deformed into oval shape when the sealing element is engaged between the barrel and the marking member. It may be advantageous for the sealing element to roll through substantially one complete revolution during movement of the marking tip between the inoperative and operative positions so that, in the normal rest positions of the sealing element, the natural inner and outer surfaces of the sealing element are at the inner and outer peripheries, respectively. To relieve compressive stresses on the sealing element when the marking tip is the extended operative position, the internal barrel surface over which the sealing element rolls can be arranged to taper rearwardly.

In order to allow the length of stroke of the marking tip between the operative and inoperative positions to be reduced without the sealing element becoming unduly stressed in its stationary positions, a lost motion connection can be included enabling the member carrying the marking tip to move relative to the barrel, without being accompanied by rolling of the sealing element, over a forward portion of the stroke when the sealing element does not make contact with the marking tip. Conveniently the lost motion connection is between the sealing element and the member carrying the marking tip and comprises a collar slidable longitudinally on the member. During advancement of the marking tip from the retracted position, the sealing element initially rolls between the barrel and the marking tip and then rolls off of the marking tip and onto the collar. Once the sealing element is substantially clear of the marking tip, the member carrying the marking tip continues to move forwardly to bring the marking tip into the operative position while the sealing element and collar remain stationary relative to the barrel. To help ensure reliable operation of the lost motion mechanism over a large number of advancement and retraction movements of the marking tip, in a preferred construction the collar is biased to a forward most position by a spring, such as a coil compression spring.

The invention is especially applicable to a writing instrument in which a replaceable refill unit is accommodated in the pen barrel and includes an ink reservoir as well as a writing tip. With such pens the sealing element could conveniently be arranged for replacement with the refill unit.

A full understanding of the invention will be gained from the following detailed description of some embodiments, reference being made to the accompanying drawings, in which.

Figure 1:
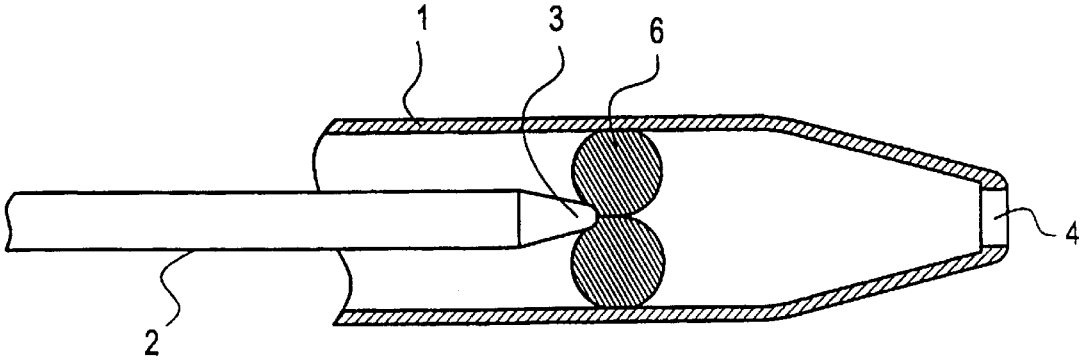
FIG. 1 is an axial section through a forward end portion of a retractable pen according to the invention, the writing tip being in a retracted position.
Figure 2:
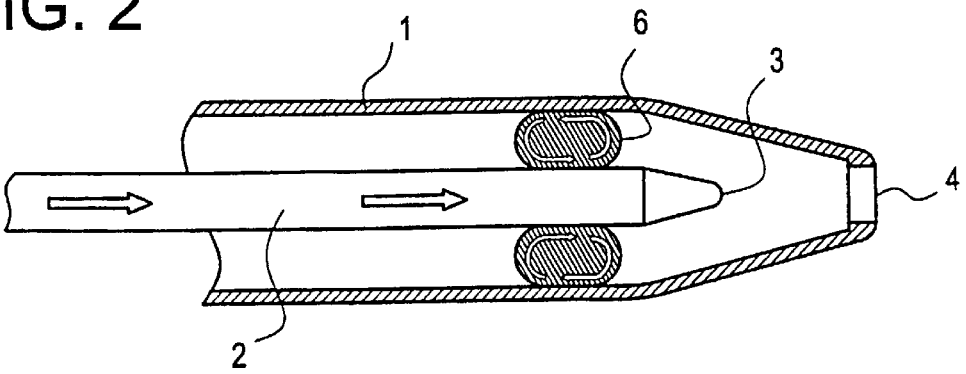
FIG. 2 shows the pen of FIG. 1 with the writing tip at an intermediate position during movement from the retracted position to an operative position.
Figure 3:
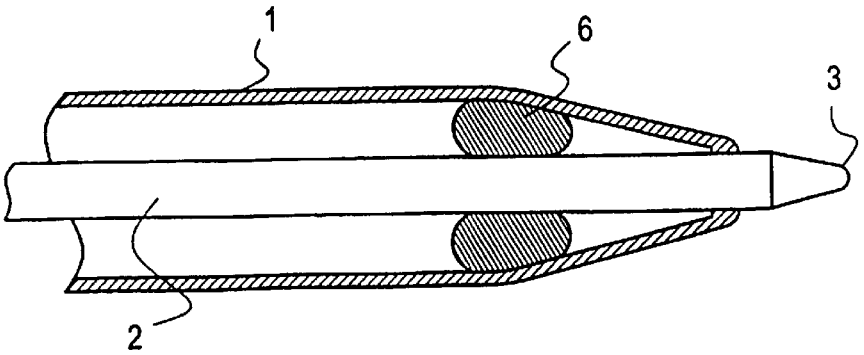
FIG. 3 shows the pen of FIG. 1 with the writing tip in the extended operative position.
Figure 15:
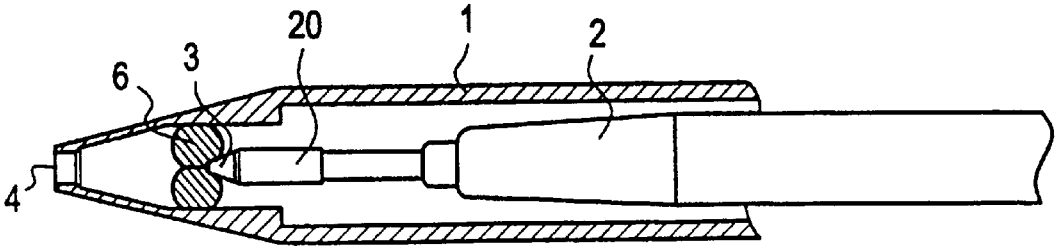
Figure 16:
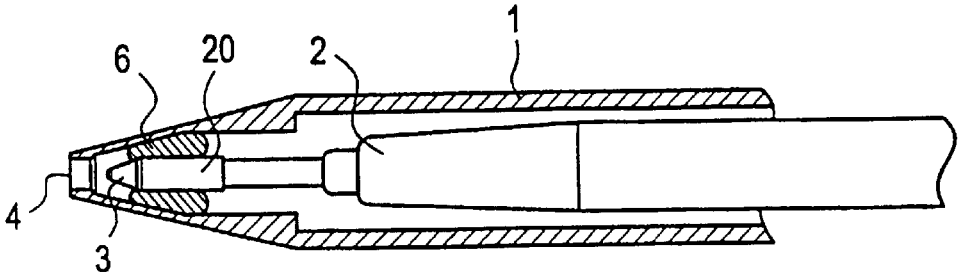
Figure 17:
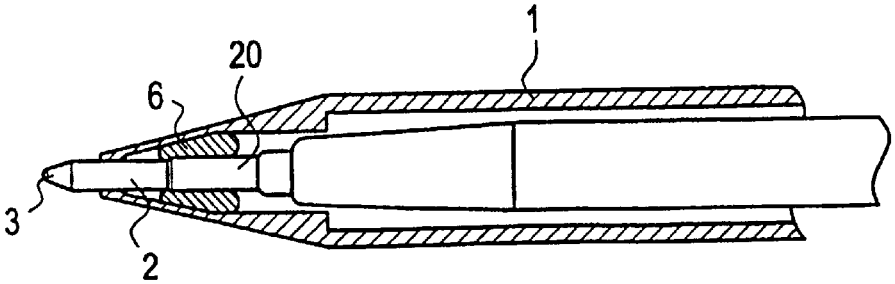
Figure 18:
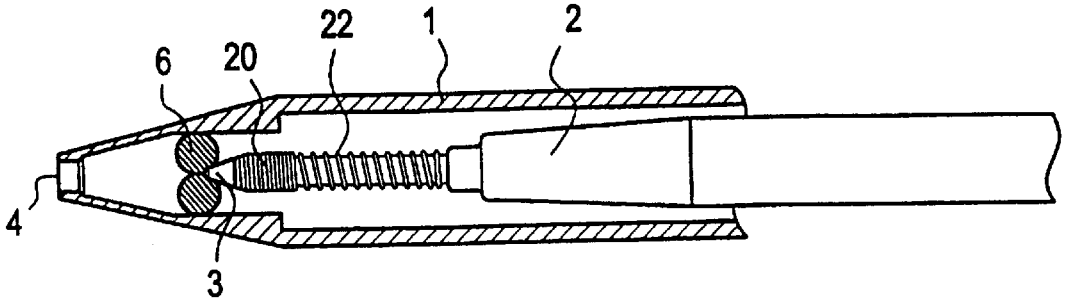
Figure 19:
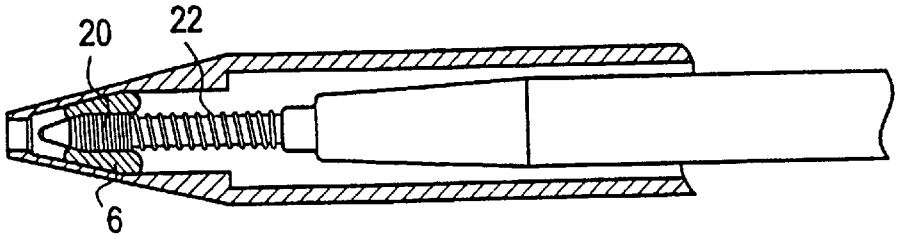
Figure 20:
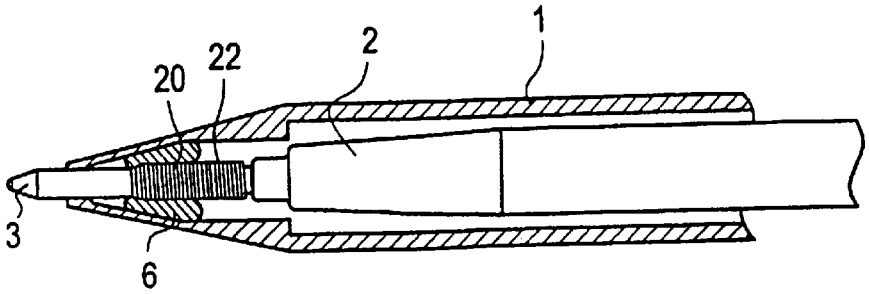

FIGS. 15, 16 and 17 are views corresponding to FIGS. 1, 2 and 3 showing an embodiment incorporating a lost motion device; and FIGS. 18, 19 and 20 are views corresponding to FIGS. 15, 16 and 17 showing an embodiment with a spring collar lost motion device.

Figure 21:
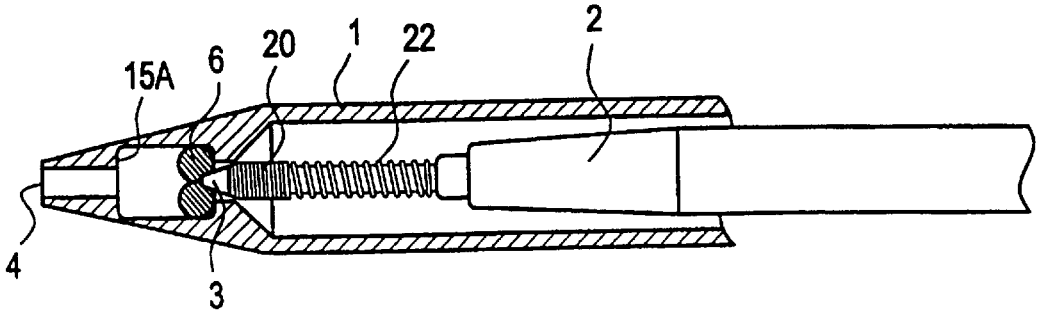
Figure 22:
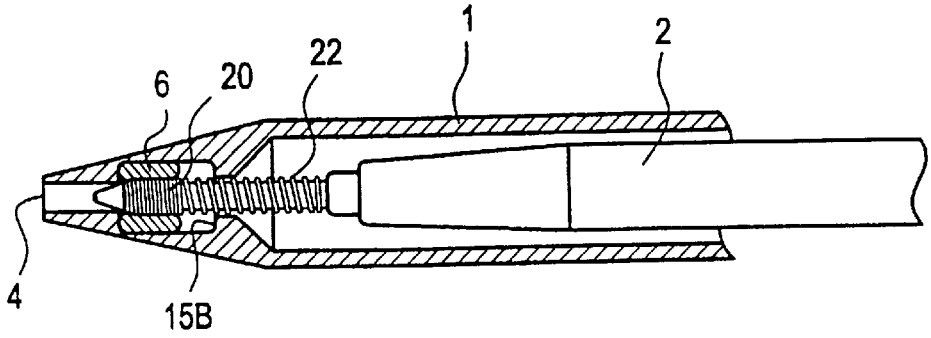
Figure 23:
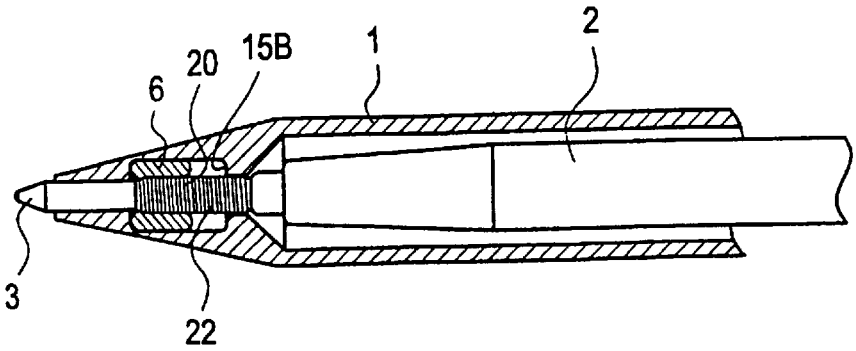
Figure 24:
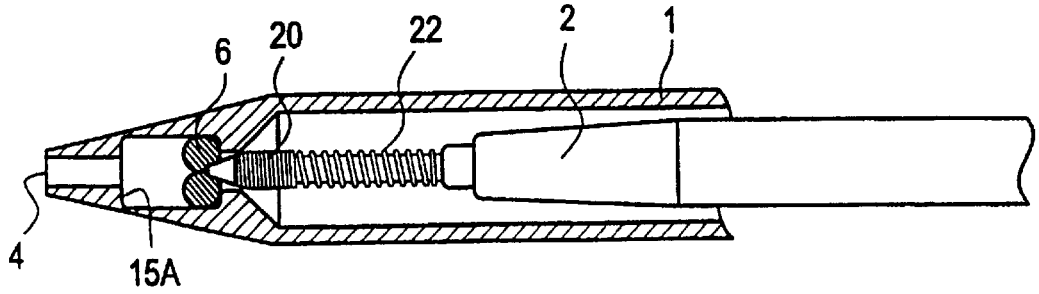
Figure 25:
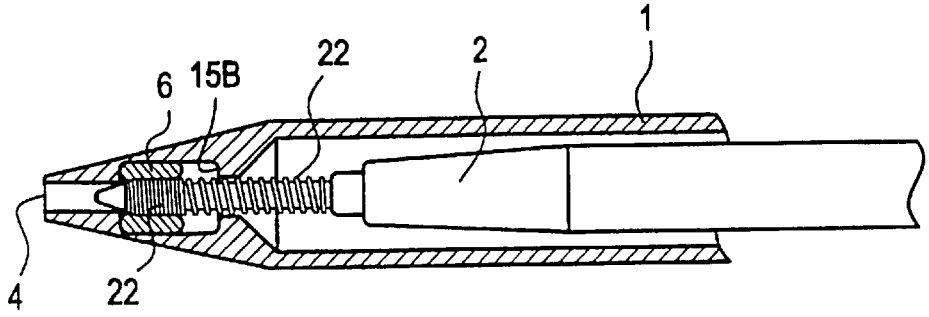
Figure 26:
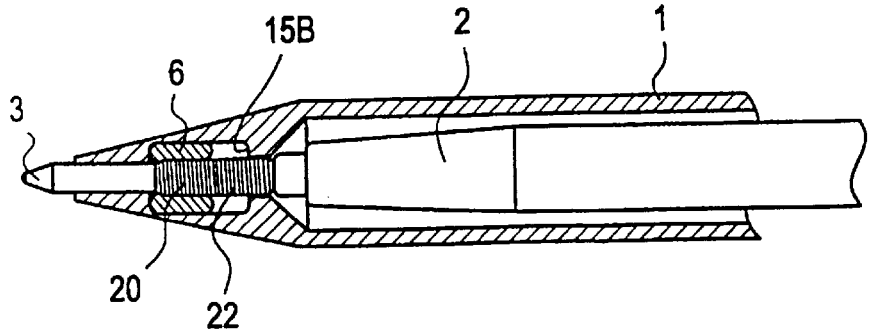
Figure 27:
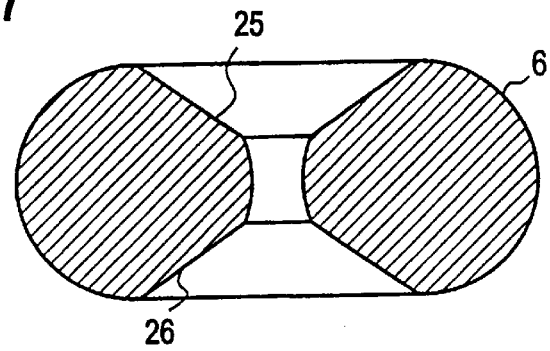
Figure 28:
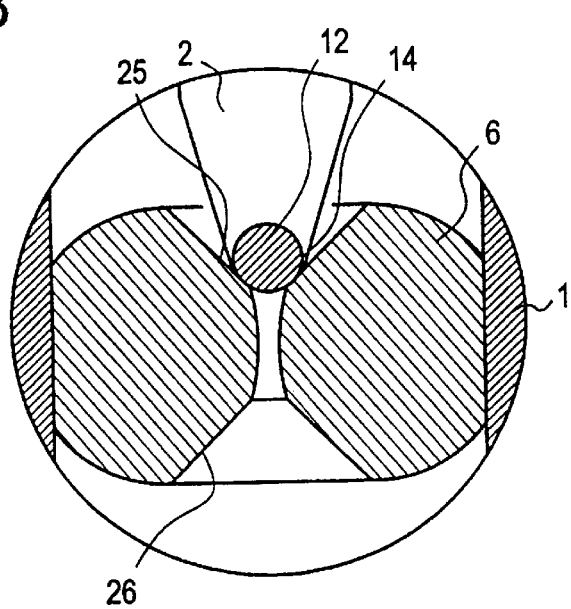
Figure 29:
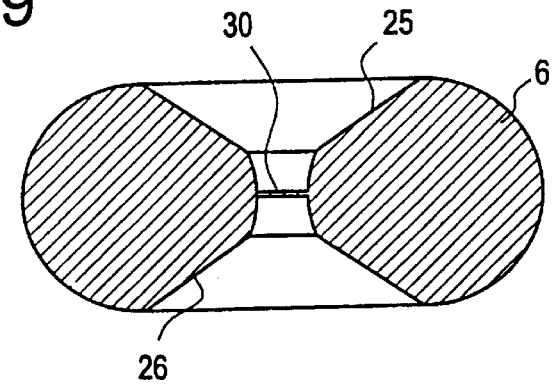
Figure 30:
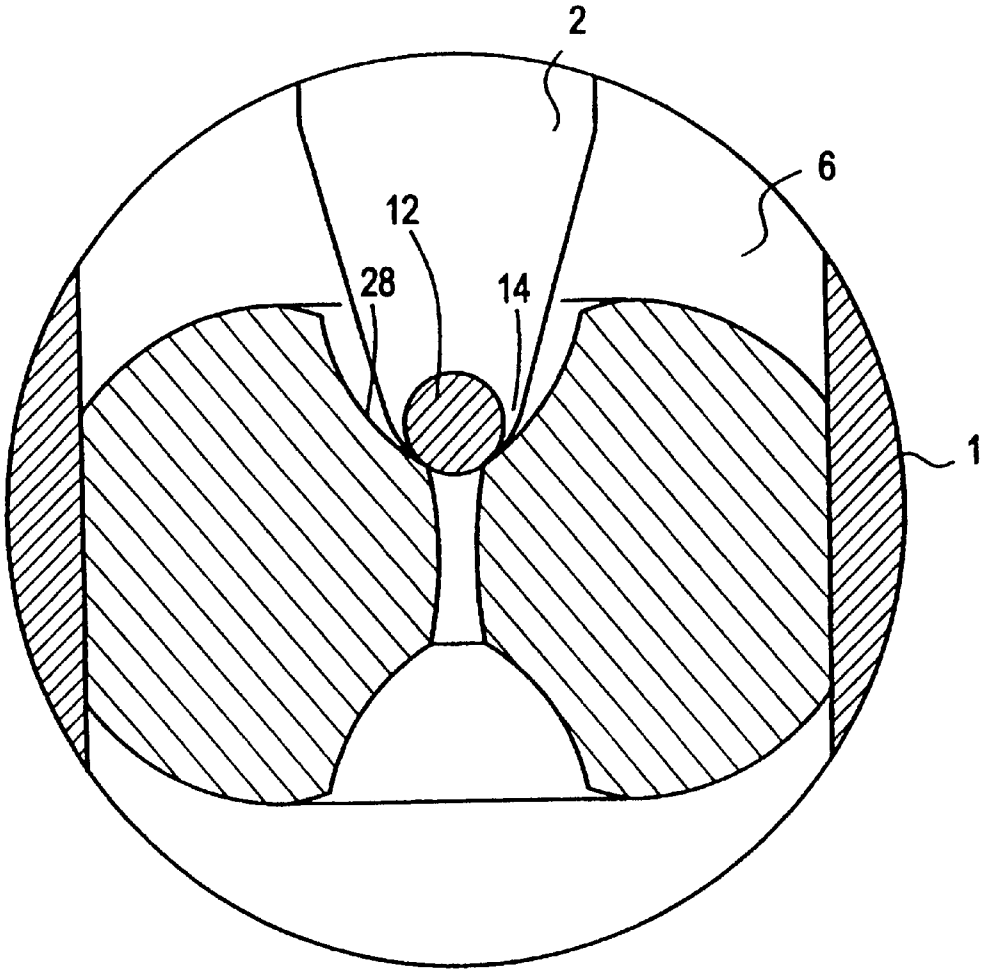

FIGS. 21, 22 and 23 correspond to FIGS. 18, 19, 20 and illustrate a modification to that embodiment;

FIGS. 24, 25, 26 correspond to FIGS. 18, 19, 20 and illustrate another modification of that embodiment;

FIG. 27 is a cross-section through an alternative form of sealing element;

FIG. 28 is a partial cross-section showing the sealing element of FIG. 27 fitting within a ball pen;

FIG. 29 is a cross-section through a sealing element having a diaphragm; and FIG. 30 is a view similar to FIG. 28 showing another form of sealing element.

The retractable pen partially illustrated in FIGS. 1–3 has a barrel 1 housing a replaceable refill unit 2 which, in a manner well known in the art, includes an ink reservoir and a writing tip 3. The pen includes a retraction mechanism for advancing and retracting the refill unit relative to the barrel for moving the writing tip from the retracted inoperative position shown in FIG. 1 to the extended operative position of FIG. 3 in which the marking tip protrudes through the opening 4 at the forward end of the barrel. The retraction mechanism has not been shown as it forms no part of the present invention and it may be any of the many forms of retraction mechanisms known in the art which provide for axial displacement of the refill unit, preferably without requiring the unit to rotate.

Figure 4:
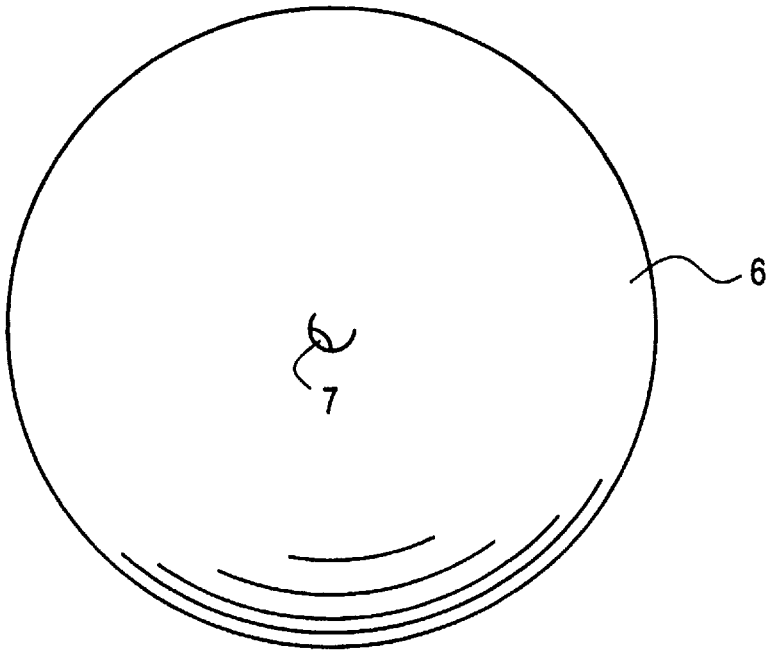
FIG. 4 shows in perspective a sealing element.
Figure 5:
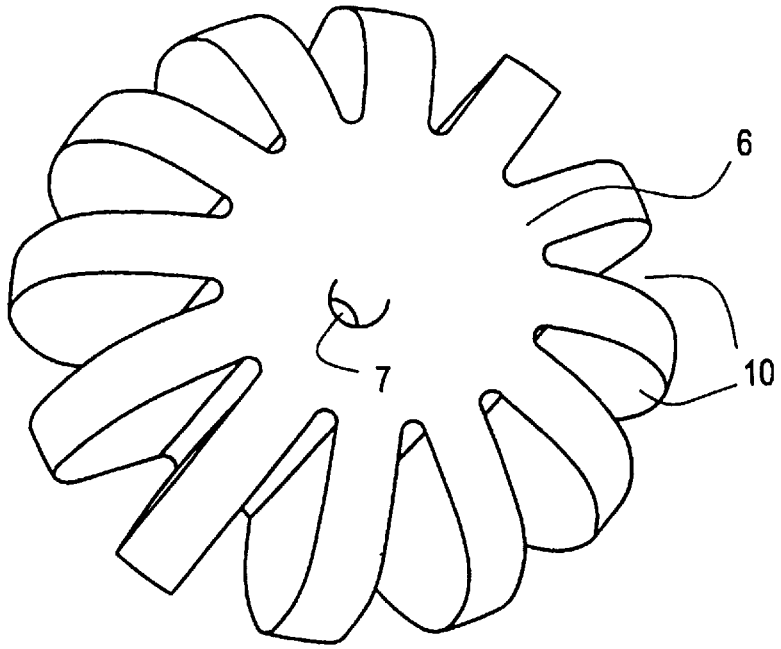
FIG. 5 shows in perspective view a modified sealing element.

Received within the barrel 1 for cooperation with the refill unit 2 is an annular sealing element 6 having the form of a torus with a small central through hole 7 as shown in FIG. 4. The sealing element is made of a soft rubber or rubber-like material, such as a copolymer, so that it makes frictional, non-sliding contact with the interior surface of the barrel 1 and with the refill unit 2. The sealing element has a substantially circular initial cross-section, but can be readily deformed into an oval shape between the barrel and refill unit. In the retracted position of the marking tip the sealing element 6 closes the internal cross-section of the barrel forwardly of the writing tip, the sealing element being radially compressed within the barrel so that the hole 7 through the sealing element is held closed. When the refill unit is driven forwards by actuation of the retraction mechanism, the writing tip 3 is pushed through the sealing element 6. the central hole 7 becoming opened up due to the soft nature of the material. As the refill unit continues its advancement, the sealing element 6 rolls between the barrel and the refill unit, as indicated by the arrows in FIG. 2, and is displaced towards the forward end of the barrel, the sealing element occupying the position shown in FIG. 3 when the writing tip is in the fully extended operative position. When the refill unit is subsequently retracted again, the sealing element 6 rolls back to the FIG. 1 position so as to close off the barrel. If it is required or desired to form a closed space around the retracted writing point, a further sealing device of any convenient form can be provided between the barrel and the refill unit rearwardly of the sealing element 6. The further sealing device could be provided by a second rolling sealing element. To reduce the internal stresses within the material of the sealing element when it is at its normal rest positions of FIGS. 1 and 3, it is beneficial to arrange for the sealing element to roll through a complete number of turns, preferably one turn, when the refill unit moves between the operative and inoperative positions. In this way the sealing element does not become parked in a completely or partially inside-out condition. To reduce stresses created during the rolling motion, the sealing element 6 can be provided with slots 10 around its periphery as shown in FIG. 5. When the sealing element is compressed within the barrel the slots can become closed up so that a sealing cooperation between the sealing elements and the barrel is still obtained.

Figure 6:
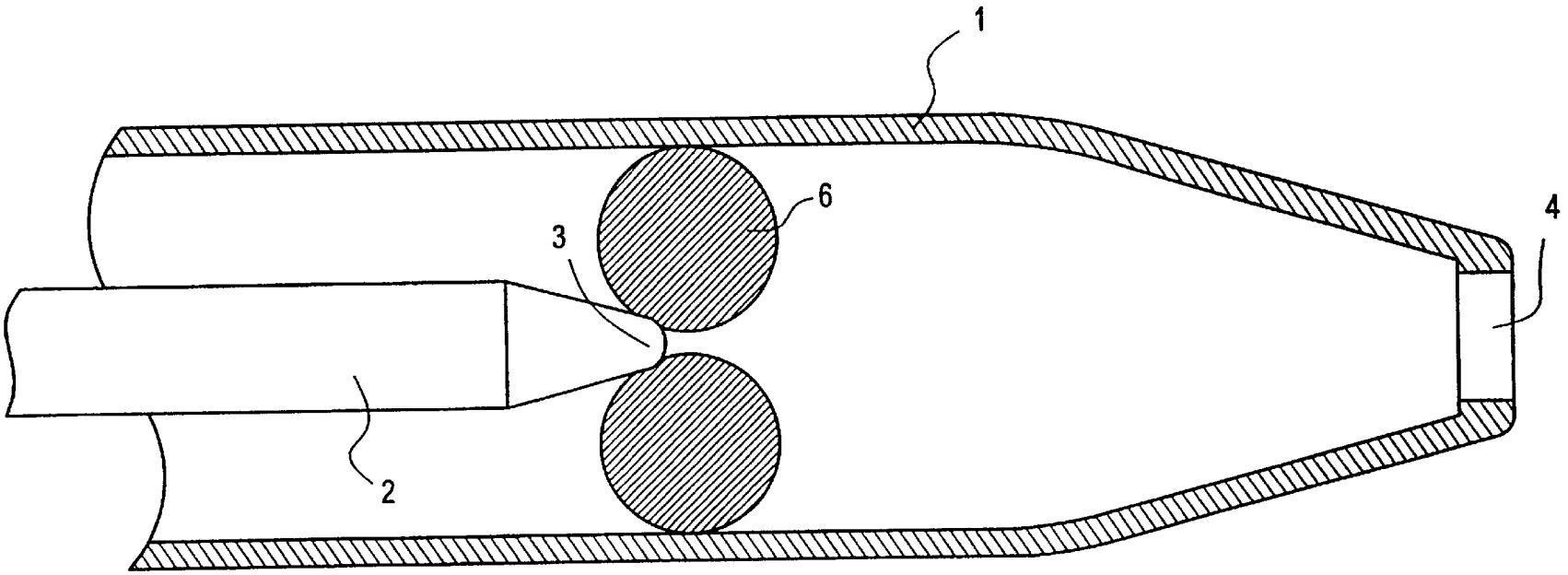
FIG. 6 shows an alternative method of sealing the pen writing tip.
Figure 7:
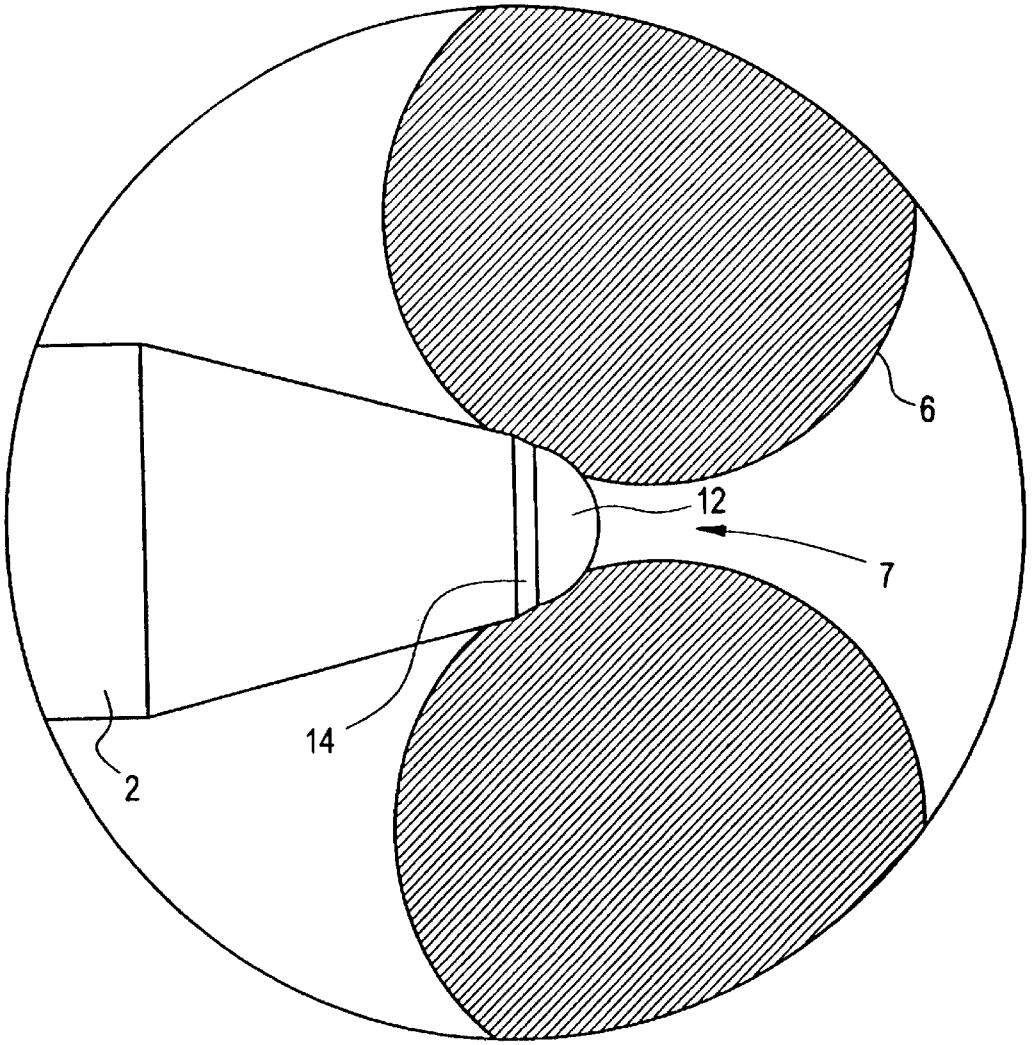
FIG. 7 shows on a larger scale the sealing arrangement of FIG. 6.

With some types of marking tip it is possible for the sealing element 6 to be effective in preventing dry out of marking fluid without having to seal across the barrel cross-section. FIGS. 6 and 7 show such a sealing arrangement in connection with a roller ball point. The hole 7 through the sealing element 6 remains open, but the sealing element engages the tip so that the annular orifice defined between the ball 12 and the rim 14 of the tip is covered by the sealing element which makes contact with the ball and rim.

Figure 8:
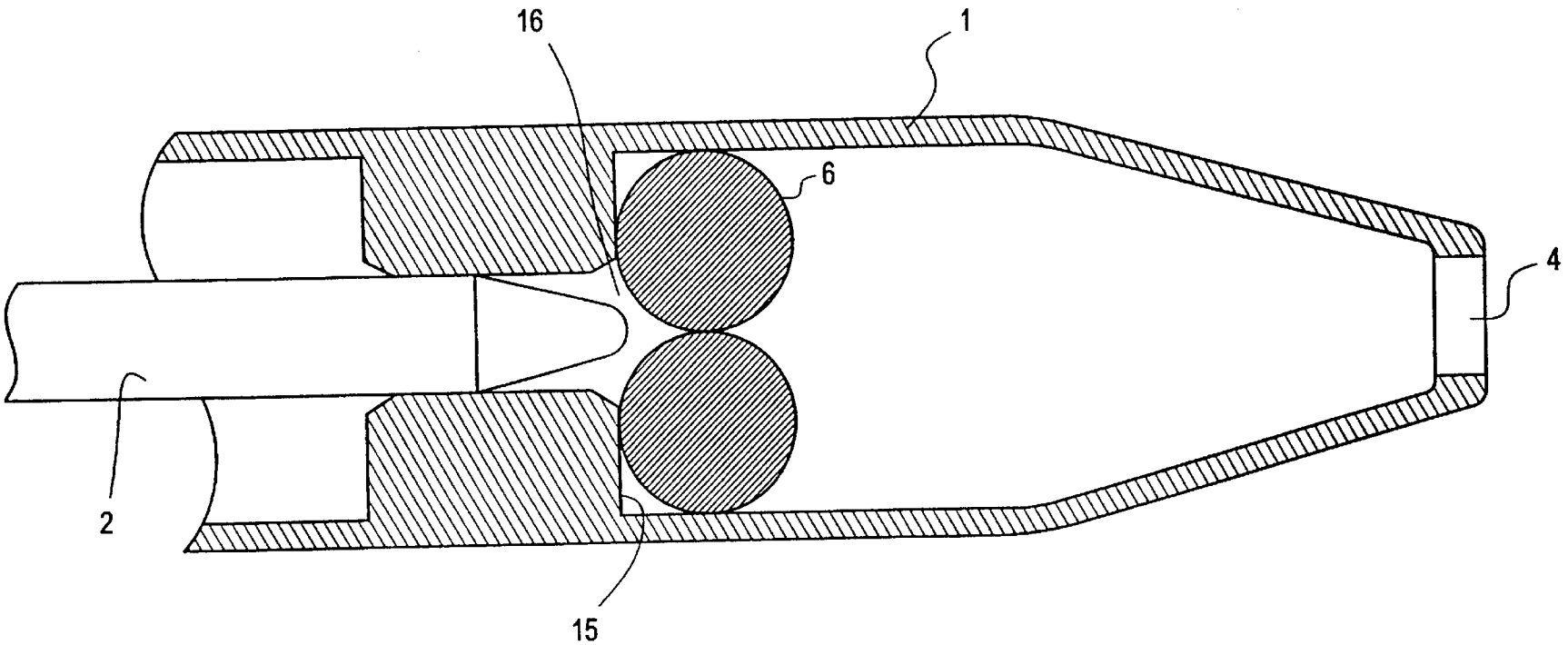
FIG. 8 is an axial section through the forward end part of another pen embodying the invention.
Figure 12:
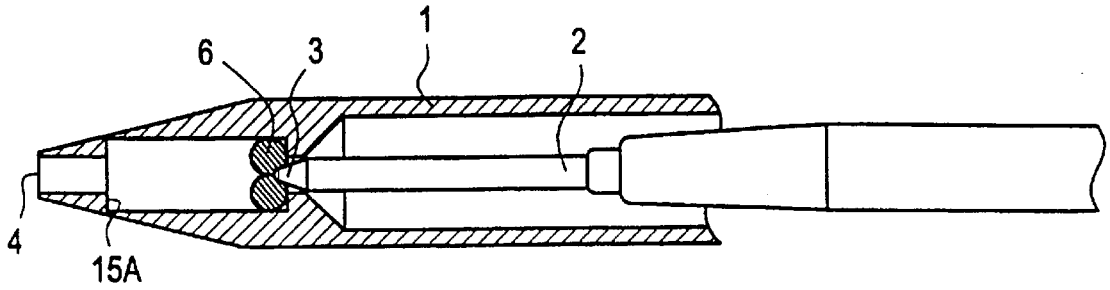
FIGS. 12, 13 and 14 are views corresponding to FIGS. 1, 2 and 3 showing another modified construction.
Figure 13:
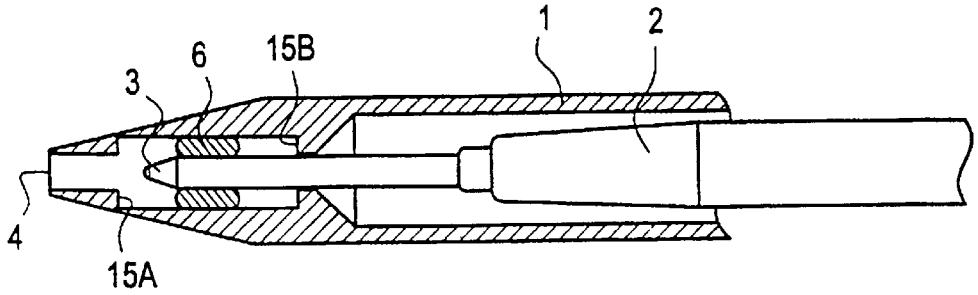
Figure 14:
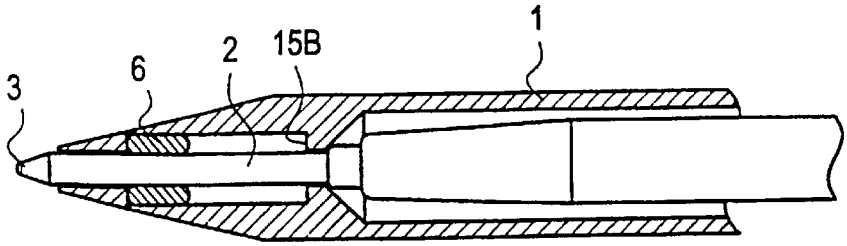

In many instances the sealing element will remain in correct position within the barrel without requiring any special measures to be taken. However, if desirable or found necessary a stop means can be included in the barrel or perhaps on the refill unit, to define one or both end positions of the sealing element. FIG. 8 shows an embodiment in which a rear stop is provided by an internal shoulder 15 in the barrel 1, the sealing element being located adjacent the shoulder when the refill unit 2 is retracted. FIG. 8 also depicts the sealing element closing off the barrel to seal a space 16 around the writing tip. FIGS. 12–14 illustrate an embodiment in which opposed shoulders 15A and 15B are spaced apart along the barrel to define front and rear end stops, respectively. The sealing element 6 is confined between the two shoulders and rolls along the barrel between the shoulders during projection and retraction movements of the refill unit. The sealing element abuts the shoulder 15A when the writing tip is fully projected and abuts the shoulder 15B when the refill unit is fully retracted. In the fully retracted position the sealing element seals the writing tip as described above. Confining the seating element between opposed stops will preclude any tendency for the sealing element to migrate along the barrel or refill unit, which could have an adverse effect on its sealing performance.

Figure 9:
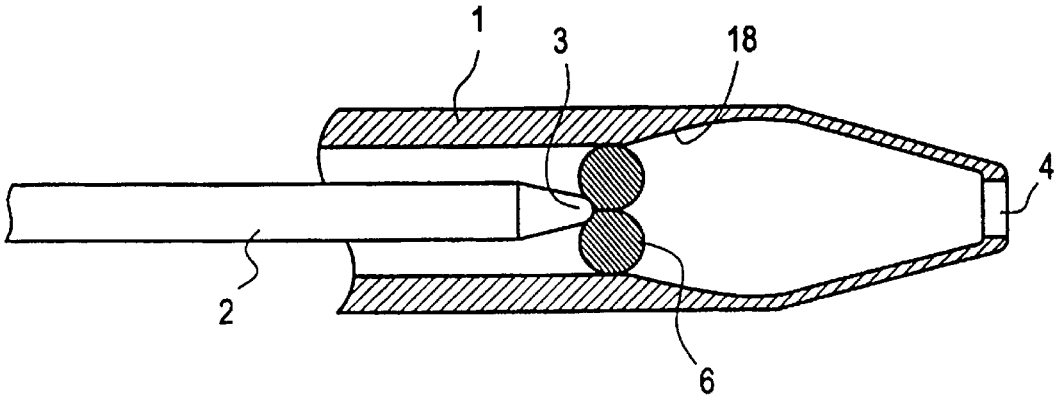
FIGS. 9, 10 and 11 are views corresponding to FIGS. 1, 2 and 3 showing a modified construction.
Figure 10:
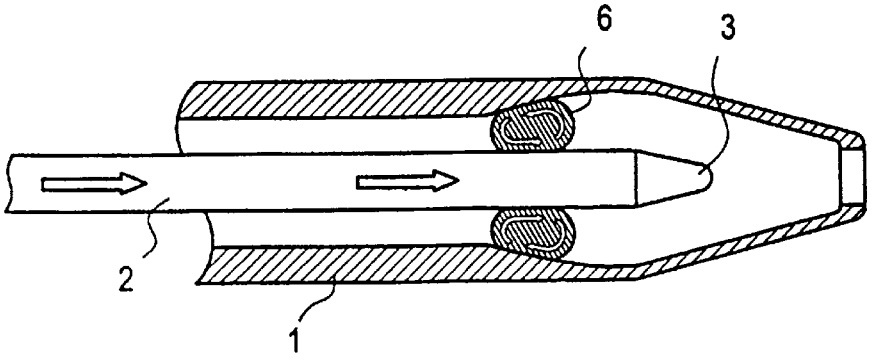
Figure 11:
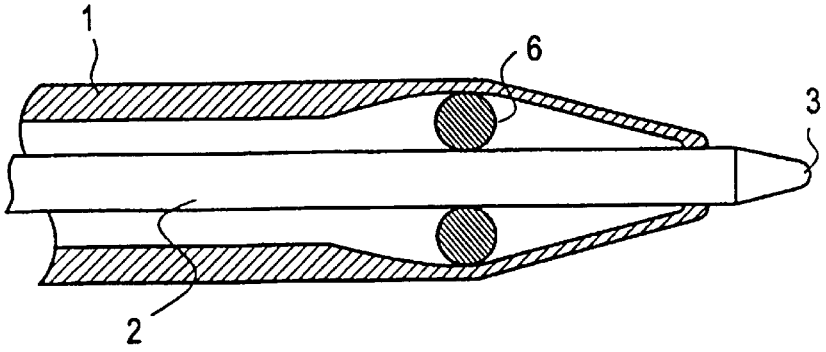

In the embodiments described above the barrel has a substantially constant diameter over the internal surface portion along which the sealing element is arranged to roll. FIGS. 9–11 illustrate another construction in which the barrel surface portion 18 with which the sealing element has rolling contact tapers rearwardly. As a result of this barrel configurations, the sealing element is allowed to expand when the writing tip is advanced to its operative position (FIG. 11) relieving the stresses within the material of the sealing element when it is not required to perform a sealing function, and the sealing element 6 becomes radially compressed when the writing tip is retracted (FIG. 9) to ensure an effective seal at or adjacent the tip 3.

As mentioned above it may be desirable for the sealing element to roll through a complete turn to avoid it becoming parked in a stressed condition when the refill unit occupies the fully retracted or fully projected position. This, in addition to the fact that the sealing element itself moves longitudinally of the barrel when the refill unit is displaced between the retracted and operative positions, means that the stroke of the refill unit between these positions may be relatively long. This potential drawback can be avoided by providing the refill unit with a lost motion device, e.g. a collar which is movable longitudinally relative to the writing tip. An embodiment incorporating a sliding collar arrangement is illustrated in FIGS. 15 to 17. The collar has the form of a sleeve 20 which is slidable on the reduced diameter forward end portion of the refill unit 2 between a stop defined adjacent the writing tip and a shoulder formed by an increase in diameter of the refill unit 2. In the retracted position of the refill unit (FIG. 15) the sealing element 6 seals off the writing tip 3 in the same manner as described above with reference to the embodiment of FIGS. 1–3. When the refill unit is displaced forwardly towards the operative position, the sealing element 6 rolls forwardly with respect to the barrel 1 and rearwardly relative to the refill unit 2 until it is engaged substantially completely with the sleeve, as shown in FIG. 16. Upon continued forward displacement of the refill unit 2 it slides forwardly relative to the sleeve 20 and the sealing element 6 which remain stationary within the barrel 1, until the writing tip 3 reaches its operative position, as shown in FIG. 17. During subsequent retraction of the refill unit the movements are reversed, the refill unit 2 sliding rearwardly until the stop adjacent the writing tip engages the forward end of the sleeve 20 and forces the sleeve to move with the refill unit, thereby causing the sealing element 6 to roll into position to seal closed the writing tip. The forward end of the barrel tapers towards the opening 4 at its front end and this produces compression of the sealing element as it rolls forwardly in the barrel to ensure good frictional cooperation with the sleeve in order to obtain the desired movements of the sleeve and sealing element relative to the refill unit 2. To help ensure that the sleeve is not displaced prematurely on the refill unit during protection of the tip it is preferably arranged to have frictional contact with the refill unit, for which purpose the sleeve may be slit longitudinal so that the sleeve grips the refill unit, or the sleeve can be dimpled. Other ways of achieving the desired frictional cooperation are of course possible. During retraction of the writing tip the frictional cooperation between the sleeve and writing tip should allow the sleeve to slide to a forwardmost position before the sealing element is caused to roll.

In the retractable pen of FIGS. 18 to 20, the collar of the lost motion device is biased to a forward most position on the refill unit by a spring 22. The spring is a coil spring which is interposed between the collar 20 and a shoulder defined between the reduced diameter front end part of the refill unit and a larger diameter rear part of the refill unit. As shown the collar 20 is formed integrally with the spring by a closely coiled spring section. The sealing arrangement in this embodiment functions as described in connection with FIGS. 15 to 17, but the spring 22 provides additional reliability in ensuring correct sliding movement of the collar over a large number of operations of the pen retraction mechanism. With this embodiment a shoulder on the refill unit limiting forward displacement of the collar 20 is not essential and as an alternative the rear end of the spring 22 can be anchored to the refill unit so the spring also serves to limit forward movement of the collar 20 relative to the refill unit.

The embodiment of the retractable pen shown in FIGS. 21 to 23 is the same as that of FIGS. 17 to 20 except that the sealing element is accommodated between front and rear stop shoulders 15A and 15B within the barrel 1, as described above in relation to FIGS. 12–14. The stop shoulders limit the movement of the sealing element 6 and define its two end positions within the barrel 1, thereby achieving additional security of correct operation of the sealing arrangement over long term use of the writing instrument during which the writing tip may be advanced and retracted a very large number of times. It will be noted that the stop shoulders 15A,15B are closer together in the pen of FIGS. 21–23, compared with that of FIGS. 12–14, since the movement of the sealing element within the barrel is reduced as a consequence of the lost motion device constituted by the collar 20.

There is shown in FIGS. 24 to 26 an embodiment of a retractable pen which is identical to that of FIGS. 21 to 23 other than for the fact that the barrel section between the stop shoulders 15A,15B includes a forward portion which tapers inwardly. As well as ensuring good frictional engagement between the sealing element 6 and the collar 20 when the writing tip 3 is advanced, the tapered portion allows the conical nose of the barrel to be made shorter, which may be desirable with a view to improving tip visibility during writing.

A modified form of sealing element suitable for use in any of the embodiments described above is illustrated in FIGS. 27 and 28. As mentioned above in relation to FIGS. 6 and 7, the sealing element can seal a ball point tip by closing the annular orifice between the ball and the rim of the tip, the sealing element being arranged to contact both ball and rim for this purpose. To provide added sealing reliability the sealing element 6 of FIG. 27 is formed with a conical inner sealing surface portion 25 which is more strongly inclined to the axis of the tip than that surface portion of a sealing element of circular cross-section which engages the writing tip. In this way reliable sealing contact between the ball and rim of the tip is ensured. As may be seen from FIG. 28 which shows the sealing element of FIG. 27 installed in a pen and in sealing cooperation with the ball 12 and rim 14 of the writing tip. It may be noted that the second conical surface 26 is provided so that the sealing element is symmetrical and does not therefore require orientation during assembly with the refill unit. A conical sealing surface for engagement with the writing tip is not essential of course and FIG. 30 illustrates an embodiment in which the sealing element 6 has a concave surface 28. This surface can lie at a large angle to the writing tip axis in the region where the surface makes contact with the ball 12 and rim 14 of the writing tip 2 so as to ensure effective sealing of the retracted tip.

There can be a very long delay between a refill unit being manufactured and it being first used in a writing instrument avoiding dry out of ink during this period is of crucial importance. The sealing element of FIG. 29 is adapted to provide additional security against dry out of ink before use of a refill by tightly sealing around the tip and for the purpose the sealing element incorporates a membrane 30, conveniently moulded integrally with the sealing element, to close the passage through the centre of the sealing element. At the time of first use, when the tip is projected for writing, it is pushed through and ruptures the membrane, after which the sealing element functions as described above in relation to the previous embodiments.

The particular embodiments described in detail above are given by way of non-limiting example only. Modifications and changes can be made within the spirit and scope of the invention and it is our intention to be limited only by the appended claims.

What is claimed is:

1. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the sealing element has slots spaced around the periphery thereof.

2. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the annular sealing element has a substantially conical or concave inner surface for cooperation with the marking tip.

3. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the interior of the barrel includes stop means to limit rolling movement of the sealing element rearwardly along the barrel.

4. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the interior of the barrel includes stop means to limit movement of the sealing element forwardly along the barrel.

5. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the barrel includes a rearwardly tapering internal surface portion along which the sealing element rolls when the marking tip is moved between the operative and inoperative positions.

6. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the barrel includes a forwardly tapering internal surface portion along which the sealing element rolls when the marking tip is advanced from the inoperative position to the operative position.

7. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein a lost motion connection is provided and allows the marking tip to move longitudinally of the barrel without causing rolling motion of the sealing tip during a forward end part of the stroke of movement of the marking tip between the operative and inoperative positions.

8. A marking instrument according to claim 7, wherein the lost motion connection comprises a lost motion device positioned between the sealing element and the member carrying the marking tip.

9. A marking instrument according to claim 8, wherein the lost motion device comprises a collar slidably carried on the member.

10. A marking instrument according to claim 9, when the collar is urged forwardly on the member by a spring.

11. A marking instrument according to claim 10, wherein the spring is a coil spring, a forward part of the spring having the coils thereof closely coupled and forming the collar.

12. A marking instrument comprising a barrel having an opening at the forward end thereof, a member carrying a marking tip for movement through the opening between an operative position protruding from the barrel and an inoperative position retracted within the barrel, an annular sealing element arranged within the barrel for frictional contact with an inner surface of the barrel and the marking member whereby the sealing element rolls there between during movement of the marking tip between the operative and inoperative positions, wherein the sealing element is provided with a membrane closing the hole there through, the membrane being rupturable by advancement of the marking tip during movement from the inoperative position to the operative position.

* * * * *